US012043999B2

(12) United States Patent
Huang et al.

(10) Patent No.: US 12,043,999 B2
(45) Date of Patent: Jul. 23, 2024

(54) DRAINAGE SYSTEM FOR PRESSURE-ASSISTED FLUSH WATER TANK

(71) Applicant: ECO (XIAMEN) TECHNOLOGY INC., Fujian (CN)

(72) Inventors: Bingxing Huang, Xiamen (CN); Dongsheng Zhang, Xiamen (CN); Shengjin Rao, Xiamen (CN)

( * ) Notice: Subject to any disclaimer, the term of this patent is extended or adjusted under 35 U.S.C. 154(b) by 131 days.

(21) Appl. No.: 17/970,584

(22) Filed: Oct. 21, 2022

(65) Prior Publication Data

US 2023/0183961 A1 Jun. 15, 2023

(30) Foreign Application Priority Data

Dec. 15, 2021 (CN) ..... 202111536800.1
Jan. 25, 2022 (CN) ..... 202210089052.5

(51) Int. Cl.
*E03D 3/00* (2006.01)
*E03D 3/10* (2006.01)

(52) U.S. Cl.
CPC ..... *E03D 3/10* (2013.01)

(58) Field of Classification Search
CPC ..... E03D 3/10
USPC ..... 4/362, 354
See application file for complete search history.

(56) References Cited

U.S. PATENT DOCUMENTS 4,232,409 A * 11/1980 Van Pham ..... E03D 5/012 4/380
4,707,868 A * 11/1987 Hennessy ..... E03D 3/10 4/380
2003/0145370 A1* 8/2003 Lee ..... E03D 3/10 4/354
2006/0101566 A1* 5/2006 Parsons ..... E03D 5/10 4/354
2010/0212078 A1* 8/2010 Dong ..... E03D 3/10 4/410

* cited by examiner

*Primary Examiner* — Huyen D Le

(57) ABSTRACT

A drainage system for a pressure-assisted flush water tank includes a tank main body and a drainage structure. The drainage structure includes an accommodating chamber and a membrane. The accommodating chamber has a drain outlet, a water inlet, and a drainpipe. The membrane partitions the accommodating chamber into a back-pressure chamber and a drainage chamber and is provided with a supplement hole that communicates the back-pressure chamber with the drainage chamber. The drain outlet is communicated with the back-pressure chamber, while the water inlet and the drainpipe are both communicated with the drainage chamber. The tank main body defines therein a storage chamber communicated with the water inlet. The membrane moves toward or departs from the drainpipe as a pressure in the back-pressure chamber varies so as to close or open the drainpipe.

11 Claims, 9 Drawing Sheets

C-C

DRAINAGE SYSTEM FOR PRESSURE-ASSISTED FLUSH WATER TANK

BACKGROUND OF THE INVENTION

1. Technical Field

The present invention relates to pressure-assisted toilet flush systems, and more particularly to a drainage system for a pressure-assisted flush water tank.

2. Description of Related Art

A modern sitting toilet is composed of a toilet pan and a water tank. The water tank has a flush system installed therein for flushing the inside of the toilet pan. Currently, most flush systems accomplish flush by converting the gravitational potential energy of water into kinetic energy of water. However, such a system disadvantageously necessities a large quantity of water and the water tank has to be situated higher than the toilet pan to a certain extent or the resulting flush is powerless. Pressure-assisted toilet flush systems have thus been developed for solving the foregoing problems. These improved systems feature for a pressure-assisted flush water tank that stores water and air. When the system is activated to flush, the compressed air and the pressure accumulated in the pressure-assisted flush water tank serve to push the water flow so that the water in the pressure-assisted flush water tank can generate a strong flushing force, thereby providing higher flushing efficiency with lower water consumption as compared to the traditional toilet flush systems.

One example of the existing pressure-assisted toilet flush systems is a toilet drain valve disclosed in China Patent Application Publication No. CN110056056A. The drain valve has a structure as shown in FIG. 1, comprising a pedestal (12), a top cover (11) connected to the pedestal (12) from above, and a rolling diaphragm (13) sandwiched by the former two. The rolling diaphragm (13) and the top cover (11) jointly define a back pressure cavity (a). The top cover (11) has a drain outlet (111) and a water inlet (112) communicated with the back pressure cavity (a). The pedestal (12) defines therein a drainage channel (b), and the pedestal (12) is provided with a discharge outlet (121). The rolling diaphragm (13) is vertically deformable. When deforming downward, the rolling diaphragm (13) comes into sealing contact with the pedestal (12) so that the drainage channel (b) and the discharge outlet (121) seal each other. When deforming upward, the rolling diaphragm (13) becomes separate from the pedestal (12) so that the drainage channel (b) and the discharge outlet (121) are in communication with each other. Additionally, the water inlet (112) is connected to a water inlet pipe through a connecting cylinder (18). In other words, the water inlet (112) is directly communicated with the water source. In practical use, in case that water comes in with high pressure and high flow, the pressure in the back pressure cavity (a) will remain high, and this can prevent drain from happening because the rolling diaphragm (13) keeps sealing between the drainage channel (b) and the discharge outlet (121). Similarly, the discharge capacity of the drain valve can vary with the current water pressure and water flow, and is relatively uncontrollable.

SUMMARY OF THE INVENTION

The objective of the present invention is to provide a drainage system for a pressure-assisted flush water tank, which simplifies drainage of a pressure-assisted toilet flush system and ensures stable water drainage of the drainage structure even if the water supply varies in terms of pressure and flow.

To achieve the foregoing objective, the present invention provides a drainage system for a pressure-assisted flush water tank, comprising a tank main body and a drainage structure; the drainage structure including an accommodating chamber and a membrane; the accommodating chamber having a drain outlet, a water inlet, and a drainpipe; the membrane being movably fit inside the accommodating chamber so as to partition the accommodating chamber into a back-pressure chamber and a drainage chamber, the membrane having a supplement hole that communicates the back-pressure chamber with the drainage chamber; the drain outlet being communicated with the back-pressure chamber, and the water inlet and the drainpipe being communicated with the drainage chamber; and the tank main body defining therein a storage chamber, and the storage chamber being communicated with the water inlet; whereby water from the storage chamber enters the drainage chamber and then enters the back-pressure chamber through the supplement hole, so as to increase a pressure in the back-pressure chamber, and when the drain outlet is open, the back-pressure chamber drains the water to decrease the pressure so that the membrane moves toward or departs from the drainpipe as the pressure in the back-pressure chamber varies, thereby closing or opening the drainpipe.

The storage chamber has a vertical water passage pipe installed therein, in which the water passage pipe has an upper end communicated with the water inlet and a lower end extending to a bottom of the storage chamber.

The back-pressure chamber has a return spring installed therein, in which the return spring is configured to return the membrane toward the drainpipe, and the accommodating chamber has an inner wall provided with an annular flange for positioning the return spring.

The drainage structure further comprises a movable seat for carrying the membrane, and the return spring is installed between the inner wall of the accommodating chamber and the movable seat, in which the movable seat has a surface provided with a plurality of retaining posts and the membrane is formed with retaining holes matching the retaining post so that the retaining posts are inserted and positioned in the retaining holes.

The supplement hole passes through the membrane and the movable seat.

The membrane has a periphery fixed to a lateral wall of the accommodating chamber, and the membrane is formed with at least a circle of deformable creases.

The drain outlet is located on an upper wall of the accommodating chamber, the water inlet and the drainpipe are both located on a lower wall of the accommodating chamber, and the drainpipe is raised from the lower wall of the accommodating chamber.

The drainage system for a pressure-assisted flush water tank further comprises a switch valve communicated with the drain outlet.

The drainage system for a pressure-assisted flush water tank further comprises a one-way air valve installed on the tank main body for allowing air supplement when the storage chamber feeds water.

The drainage system for a pressure-assisted flush water tank further comprises a pressure relief cover; the drainage structure being installed in the tank main body; the tank main body being formed with a recess that acts as the drainage chamber, and the storage chamber and the drainpipe being both communicated with the recess; and the pressure relief cover being fit inside the recess and working with the recess to hold the periphery of the membrane; the back-pressure chamber being defined between the pressure relief cover and the membrane, and the pressure relief cover being formed with the drain outlet.

The drainage structure is a separate device located outside the tank main body; the drainage structure including a valve body that defines the accommodating chamber therein, and having an inlet end cap and an outlet end cap both detachably connected to the valve body, the inlet end cap being provided with at least one of the water inlet, and the outlet end cap being provided with at least one of the drainpipe.

With the configuration described above, in use of the drainage system for a pressure-assisted flush water tank of the present invention, water supplied first enters the storage chamber and then enters the drainage chamber so as to ensure stable water drainage of the drainage structure even if the water supply varies in terms of pressure and flow. By providing the movable membrane that partitions the accommodating chamber into the back-pressure chamber and the drainage chamber, and having the back-pressure chamber communicated with the drain outlet, and having the drainage chamber communicated with the water inlet and the drainpipe, when the back-pressure chamber releases its pressure, the water pressure at the water inlet will push the membrane away from the drainpipe, thereby creating a waterway from the storage chamber to the drainpipe through the water inlet and the drainage chamber successively, so the storage chamber is allowed to drain water. No matter how the water pressure at the water supply varies, the pressure always pushes the membrane to open, and will never cause a counterforce. This ensures that the pressure-assisted flush water tank drains water stably. Moreover, with provision of the supplement hole, no matter how the membrane moves, water supplement can be made to the back-pressure chamber timely so as to restore the original pressure to push the membrane to stop the communication between the drainage chamber and the drainpipe.

DETAILED DESCRIPTION OF THE INVENTION

Figure 1:
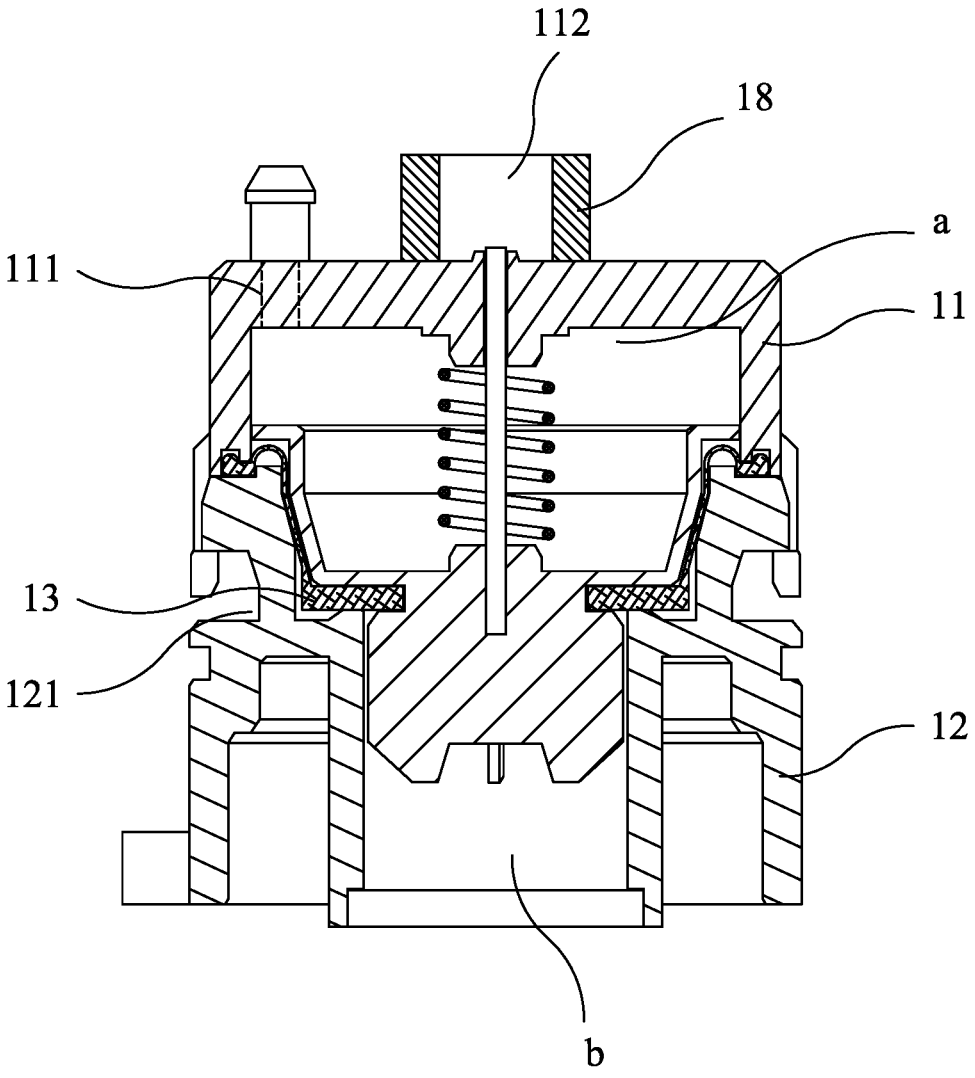
FIG. 1 (PRIOR ART)
FIG. 1 is a schematic structural drawing of a drain valve according to China Patent Application Publication No. CN110056056A.
Figure 2:
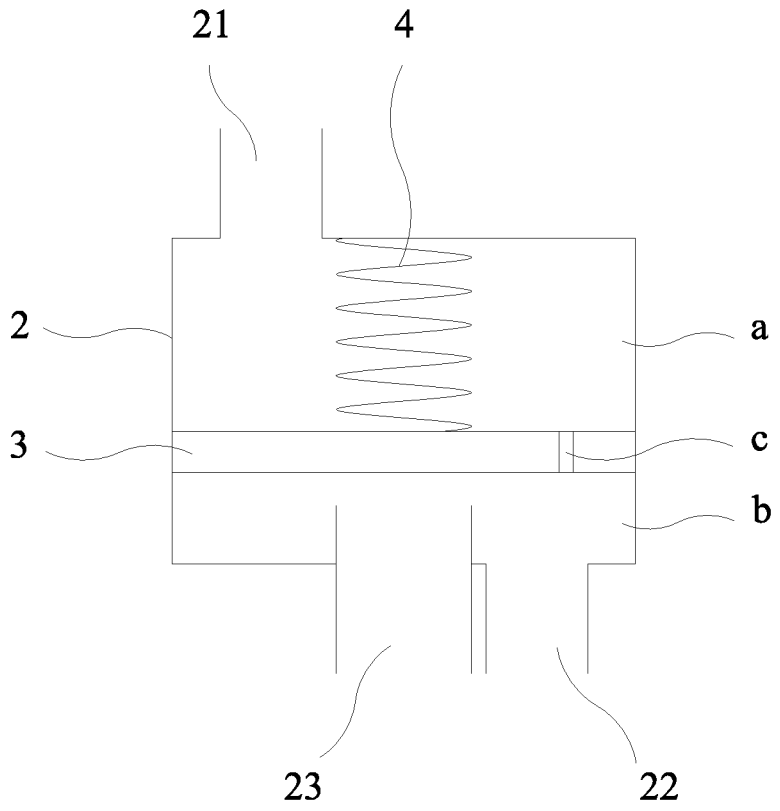
FIG. 2 is a schematic structural drawing of a drainage structure according to the present invention.

The present invention will be further explained with reference to some specific embodiments.

The present invention provides a drainage system for a pressure-assisted flush water tank, comprising a tank main body 1 and a drainage structure.

The drainage structure comprises an accommodating chamber 2 and a membrane 3. The accommodating chamber 2 is provided with a drain outlet 21, a water inlet 22, and a drainpipe 23. The membrane 3 is movably fit inside accommodating chamber 2 so as to partition the accommodating chamber 2 into a back-pressure chamber and a drainage chamber b. The membrane 3 is further provided with a supplement hole c communicating the back-pressure chamber a with the drainage chamber b. The drain outlet 21 is communicated with back-pressure chamber a. The water inlet 22 and the drainpipe 23 are both communicated with the drainage chamber b.

The tank main body 1 has a storage chamber 11. The storage chamber 11 is communicated with the water inlet 22.

When water is supplied from the storage chamber 11, the water enters the drainage chamber b, and then enters the back-pressure chamber a through the supplement hole c so that the pressure in the back-pressure chamber a increases. When the drain outlet 21 is open, the back-pressure chamber a drains water so the pressure decreases. The membrane 3 moves toward or departs from the drainpipe 23 as the pressure in the back-pressure chamber a varies, thereby closing or opening the drainpipe 23.

With the configuration described above, by providing the movable membrane 3 that partitions the accommodating chamber 2 into the back-pressure chamber a and the drainage chamber b, and having the back-pressure chamber a communicated with the drain outlet 21, and having the drainage chamber b communicated with the water inlet 22 and the drainpipe 23, when the back-pressure chamber releases its pressure, the water pressure at the water inlet 22 will push the membrane 3 away from the drainpipe 23, thereby creating a waterway from the storage chamber 11 to the drainpipe 23 through the water inlet 22 and the drainage chamber b successively, so the storage chamber 11 is allowed to drain water. The supplied water enters the storage chamber 11 first and then enters the drainage chamber b, so that the drainage structure drains water stably even if the water supply varies in terms of pressure and flow. No matter how the water pressure at the water supply (i.e., the water source) varies, the pressure always pushes the membrane 3 to open, and will never cause a counterforce. This ensures that the pressure-assisted flush water tank drains water stably. Moreover, with provision of the supplement hole c, no matter how the membrane 3 moves, water supplement can be made to the back-pressure chamber a timely so as to restore the original pressure to push the membrane 3 to stop the communication between the drainage chamber b and the drainpipe 23.

Depicted in FIG. 2 through FIG. 9 are some specific embodiments of the present invention. In some embodiments of the drainage structure, the storage chamber 11 has a vertical water passage pipe 12 installed therein, in which the water passage pipe 12 has an upper end communicated with the water inlet 22 and a lower end extending to a bottom of the storage chamber 11, so as to ensure that the storage chamber 11 empties after water drainage.

In some embodiments of the drainage structure, the back-pressure chamber a has a return spring 4 installed therein. The return spring 4 is configured to return the membrane 3 toward the drainpipe 12. The accommodating chamber 2 has an inner wall provided with an annular flange 24 for positioning the return spring 4. This helps prevent that the return spring 4 fails to return the membrane 3 due to any positional change happening during compression/restoration of the return spring 4. The return spring 4 serves to prevent that the membrane 3 gets fully attached to the lateral wall of the accommodating chamber 2 during water drainage to the extent that water supplement to the back-pressure chamber a becomes impossible. The return spring 4 also ensures restoration of the membrane 3 after water drainage, thereby maintaining stable function throughout repeated operation of the drainage structure.

Figure 4:
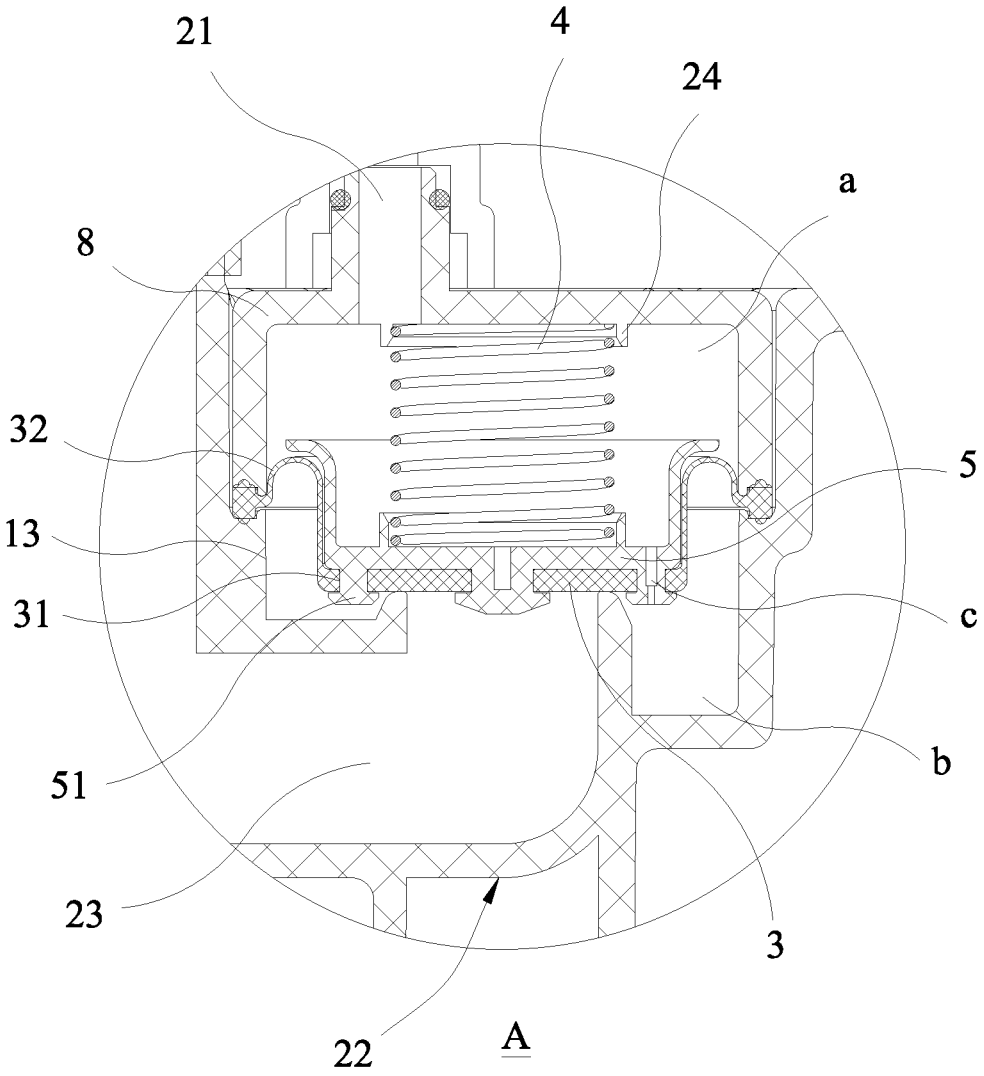
FIG. 4 is a close-up view of Part A in FIG. 3.

In some embodiments of the drainage structure, as shown in FIG. 4, the drainage structure further comprises a movable seat 5 for carrying the membrane 3. The return spring 4 is installed between the inner wall of the accommodating chamber 2 (i.e., the back-pressure chamber a) and the movable seat 5. The movable seat 5 serves to hold the central part of the membrane 3 in shape, so as to ensure that when the membrane 3 moves toward the drainpipe 23 under the acting forces of the pressure in the back-pressure chamber a and the return spring 4, it can fully cut off the communication between the drainpipe 23 and the drainage chamber b, thereby preventing any water leakage except for intended water drainage.

Further, the movable seat 5 has its surface provided with a plurality of retaining posts 51 and the membrane 3 is formed with retaining holes 31 matching the retaining post 51 so that the retaining posts 51 are inserted and positioned in the retaining holes 31, thereby achieving mutual positioning between the membrane 3 and the movable seat 5.

Further, the supplement hole c passes through the membrane 3 and the movable seat 5. Given the fact that the diameter of the supplement hole c is the key factor of the water flow from the water inlet 22 to the back-pressure chamber a, and the time taken by water supplement for the drainage structure can be controlled by changing the diameter of the supplement hole c, time taken by water drainage of the drainage structure can be adjusted according to different needs. With the supplement hole c formed on the membrane 3 and the movable seat 5, it is possible to fast obtain the supplement hole c of the suitable diameter by replacing the membrane 3 and the movable seat 5, thereby saving manufacturing costs and satisfying various needs of users.

In some embodiments of the drainage structure, the membrane 3 has its periphery fixed to the lateral wall of the accommodating chamber 2, and the membrane 3 is provided with at least one circle of deformable creases 32. The creases 32 ensure that the membrane 3 is able to elastically deform in response to external force.

In some embodiments of the drainage structure, the drain outlet 21 is located on the upper wall of the accommodating chamber 2. The water inlet 22 and the drainpipe 23 are located on the lower wall of the accommodating chamber 2, and the drainpipe 23 is raised from the lower wall of the accommodating chamber 2, so that the membrane 3 when blocking the inlet end of the drainpipe 23 (i.e., the joint between the drainpipe 23 and the drainage chamber b) is prevented from moving downward anymore to block the water inlet 22 and causing water supplement of the back-pressure chamber a impossible. It is understandable that the upper wall and the lower wall are so designated to describe the relative locations among the drain outlet 21, the water inlet 22, and the drainpipe 23, but not intended to limit any other possible installations.

The present invention further comprises a switch valve 6 communicated with the drain outlet 21. The switch valve 6 acts as a "control switch" of the drain outlet 21. When the switch valve 6 is pressed, the water in the back-pressure chamber a is drained through the drain outlet 21 so that the pressure in the back-pressure chamber a decreases, thereby accomplish water drainage.

The present invention further comprises a one-way air valve 7 installed on the tank main body 1 for allowing air supplement when the storage chamber 11 supplies water.

Figure 3:
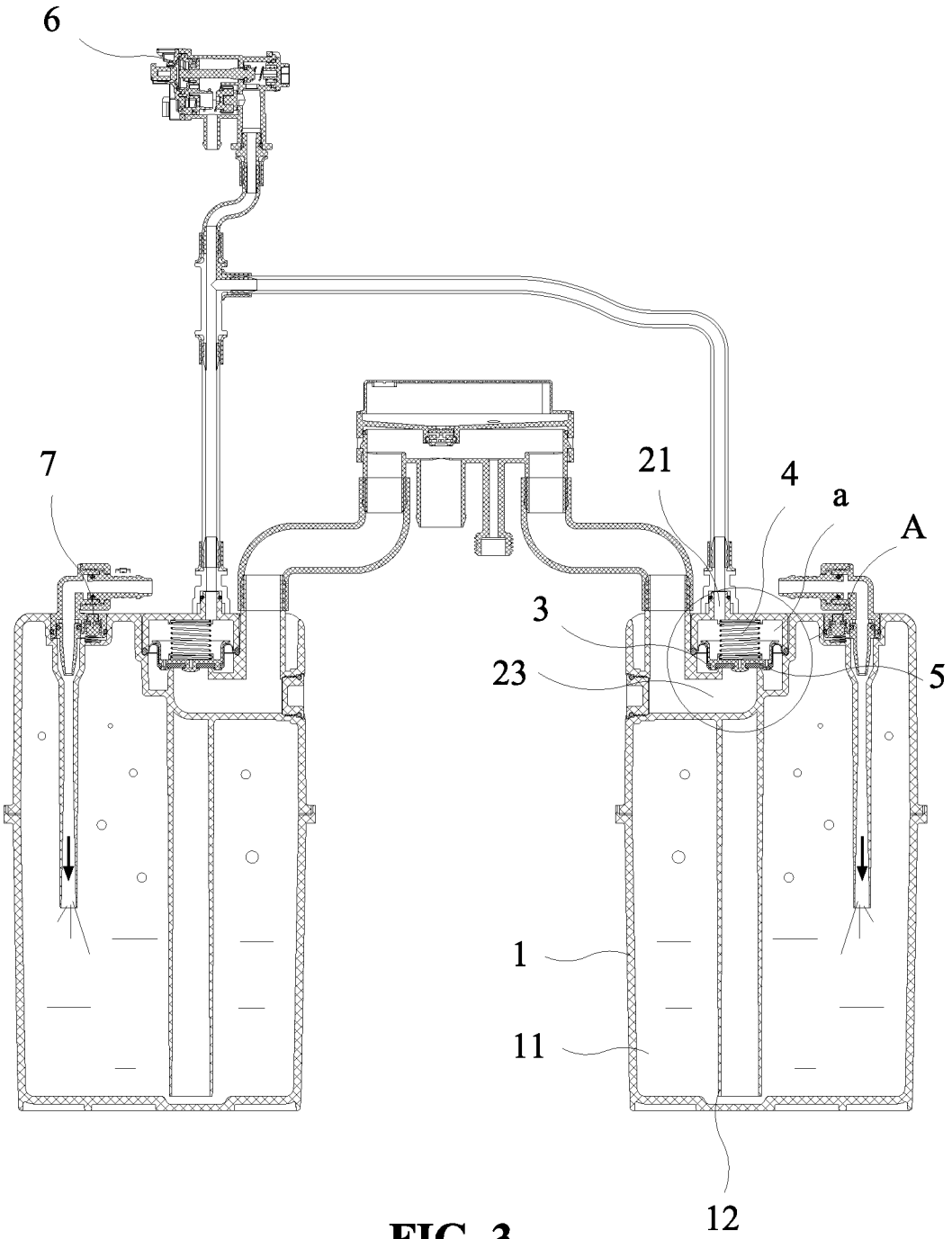
FIG. 3 is a schematic structural drawing of a tank main body according to a first embodiment of the present invention, wherein water is filled.
Figure 5:
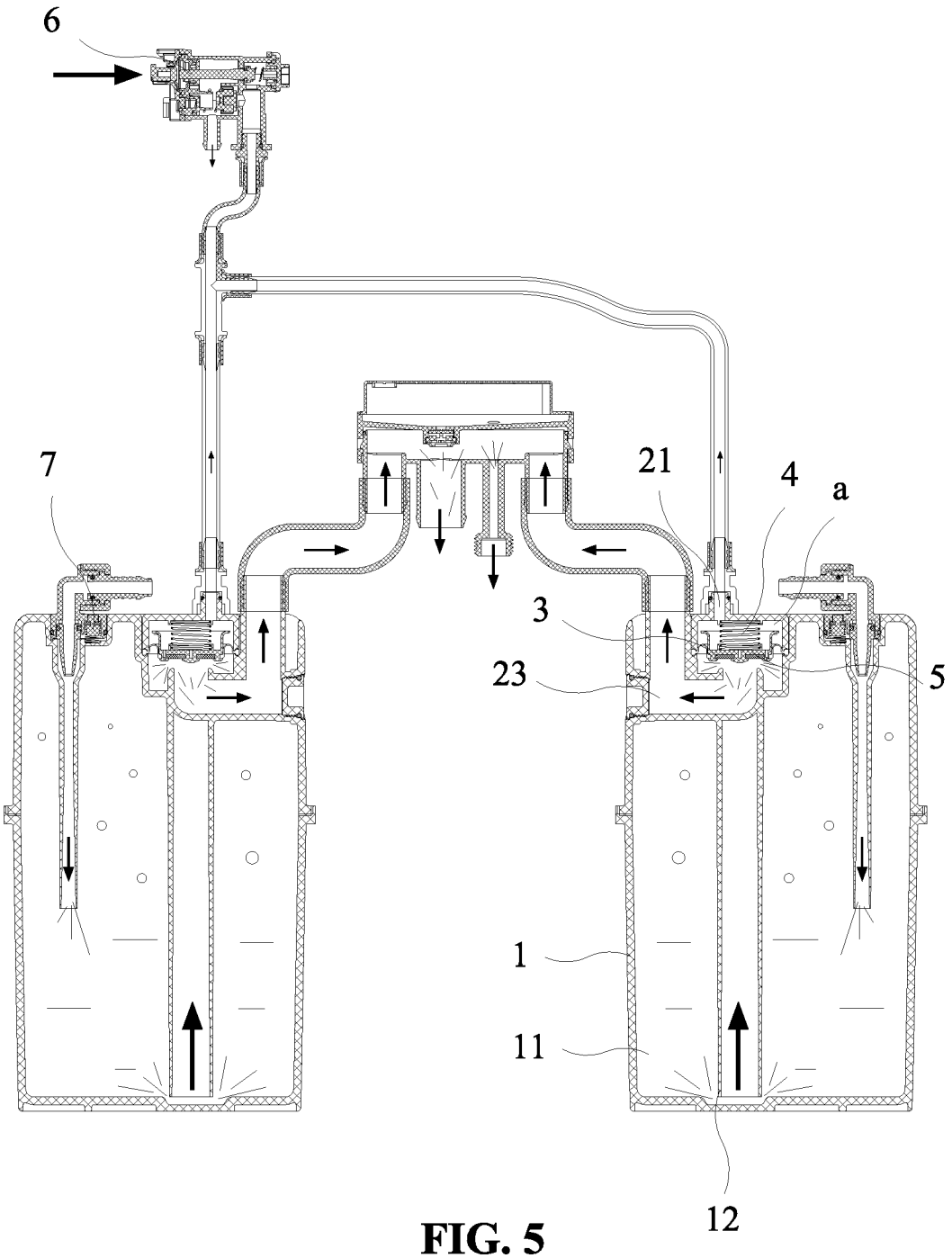
FIG. 5 is a schematic structural drawing of the tank main body according to the first embodiment of the present invention, wherein water is drained.

The tank main body 1 may be implemented in many other ways. FIG. 3 through FIG. 5 provide the first embodiment of the tank main body 1.

The present invention further comprises pressure relief cover 8. The drainage structure is installed inside the tank main body 1. The tank main body 1 is formed with a recess 13 that acts as the drainage chamber b. The water passage pipe 12 and the drainpipe 23 are both communicated with the recess 13. The upper end of the water passage pipe 12 acts as the foregoing water inlet 22. The pressure relief cover 8 is fit inside the recess 13 and works with the recess 13 to hold the periphery of the membrane 3. The back-pressure chamber a is defined between the pressure relief cover 8 and the membrane 3, and the back-pressure chamber a is provided with the foregoing drain outlet 21.

Referring to FIG. 3, during water filling, a pressure regulating valve of the pressure-assisted toilet flush system supplies water to the tank main body 1, and the storage chamber 11 starts to fill air and water. The water flow enters the drainage chamber b through the water passage pipe 12, and then enters the back-pressure chamber a through the supplement hole c, so as to gradually pushes the membrane 3 to move toward the drainpipe 23, until the membrane 3 blocks the inlet end of the drainpipe 23, so the pressure in the back-pressure chamber a starts to build up, until the pressure and the water pressure in the drainage chamber b/storage chamber 11 come to balance. At this time, water filling is finished.

Referring to FIG. 5, for water drainage, the switch valve 6 is operated, so the water in the back-pressure chamber a flows toward the switch valve 6 through the drain outlet 21 before draining. As a result, the pressure in the back-pressure chamber a decreases, and the water pressure in the drainage chamber b/storage chamber 11 pushes the membrane 3 to open the inlet end of the drainpipe 23, thereby starting water drainage. While the drainpipe 23 drains water, additional water is supplied to the back-pressure chamber a through the supplement hole c, so that the membrane 3 returns toward the drainpipe 23 slowly. At the expiration of the predetermined water drainage duration, the membrane 3 blocks the drainpipe 23 again to finish water drainage.

FIG. 6 through FIG. 9 depict the second embodiment of the tank main body 1.

The drainage structure herein is a separate device located outside the tank main body 1. With the drainage structure separated from the pressure-assisted flush water tank, by changing the numbers of the pipes from the water inlet 22 and the drainpipe 23 to the outside, it is possible to use a single drainage structure to control multiple tank main bodies 1, so as to reduce the number of parts used in the pressure-assisted toilet flush system, thereby simplifying assembling works and lowering manufacturing costs.

Further, the drainage structure includes a valve body d that defines the accommodating chamber 2 therein, and has an inlet end cap e and an outlet end cap f both detachably connected to the valve body d. The inlet end cap e is provided with at least one of the water inlet 22, and the outlet end cap f is provided with at least one of the drainpipe 23. Thus, by using different inlet and outlet end caps e and f, the use needs with different numbers of connections (the number of corresponding pressure-assisted flush water tanks and the number of target drainage functions, such as primary flushing water and rinsing water) can be satisfied.

Figure 6:
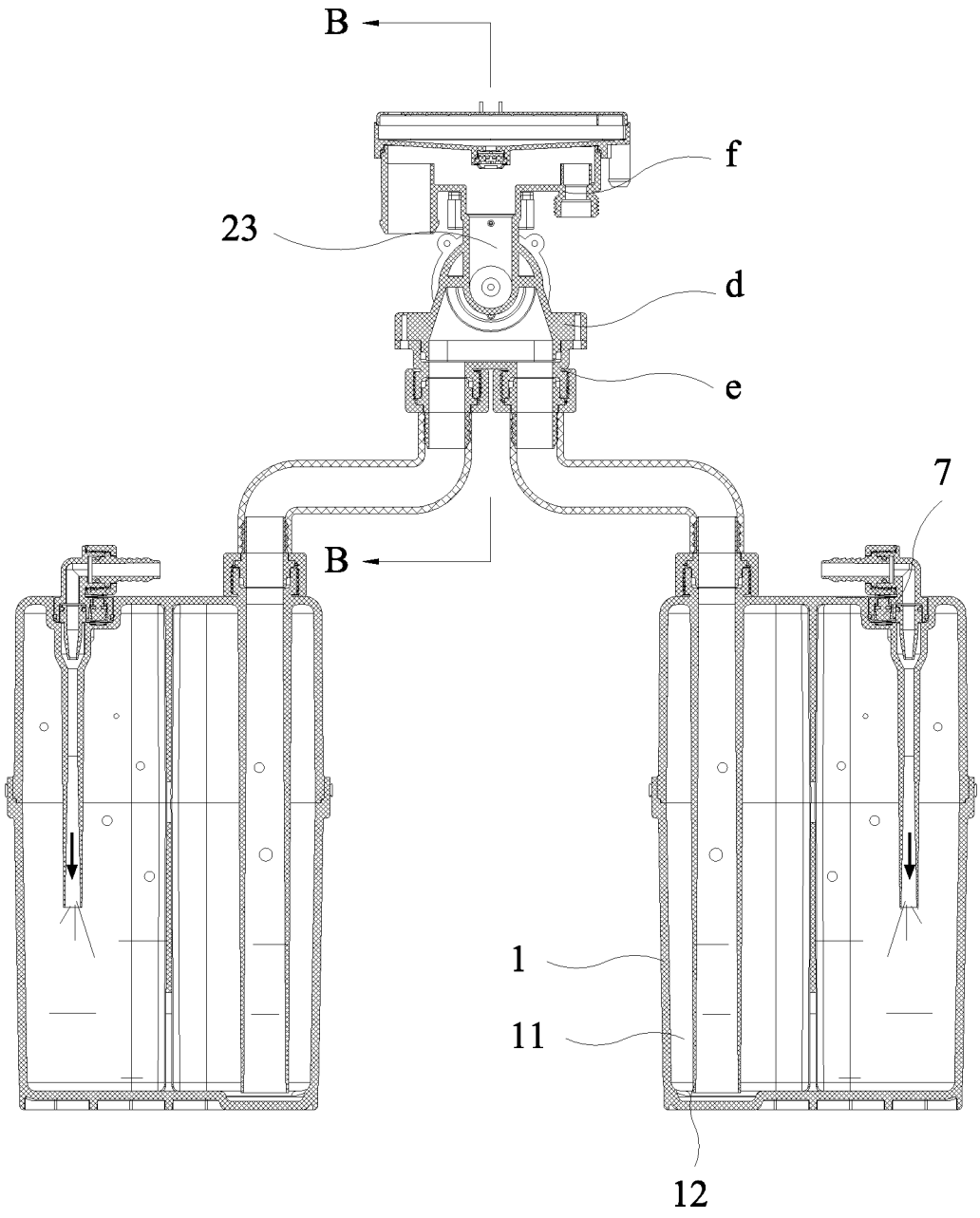
FIG. 6 is a schematic structural drawing of a tank main body according to a second embodiment of the present invention, wherein water is filled.
Figure 7:
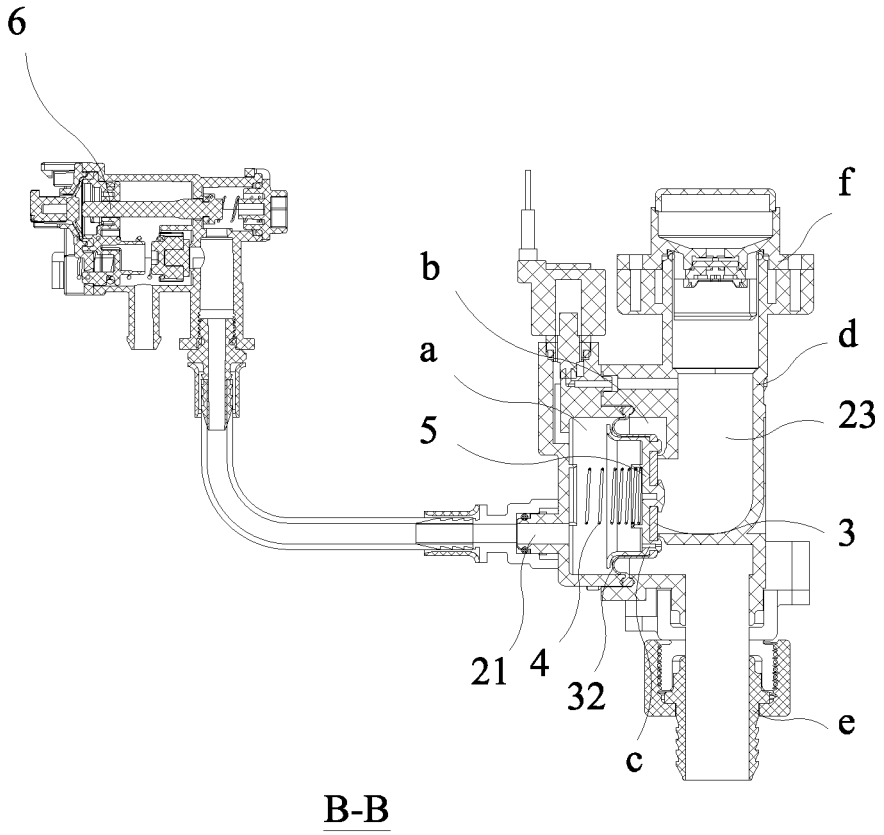
FIG. 7 is a cross-sectional view made along Line B-B in FIG. 6.

Referring to FIG. 6 and FIG. 7, during water filling, a pressure regulating valve of the pressure-assisted toilet flush system supplies water to the pressure-assisted flush water tank, and the storage chamber 11 starts to fill air and water. The water flow enters the drainage chamber b of the valve body d through the water passage pipe 12, and then enters the back-pressure chamber a through the supplement hole c, so as to gradually pushes the membrane 3 to move toward the drainpipe 23, until the membrane 3 blocks the inlet end of the drainpipe 23. Then the pressure in the back-pressure chamber a start to build up, until the pressure and the water pressure of the drainage chamber b/storage chamber 11 come to balance. At this time, water filling is finished.

Figure 8:
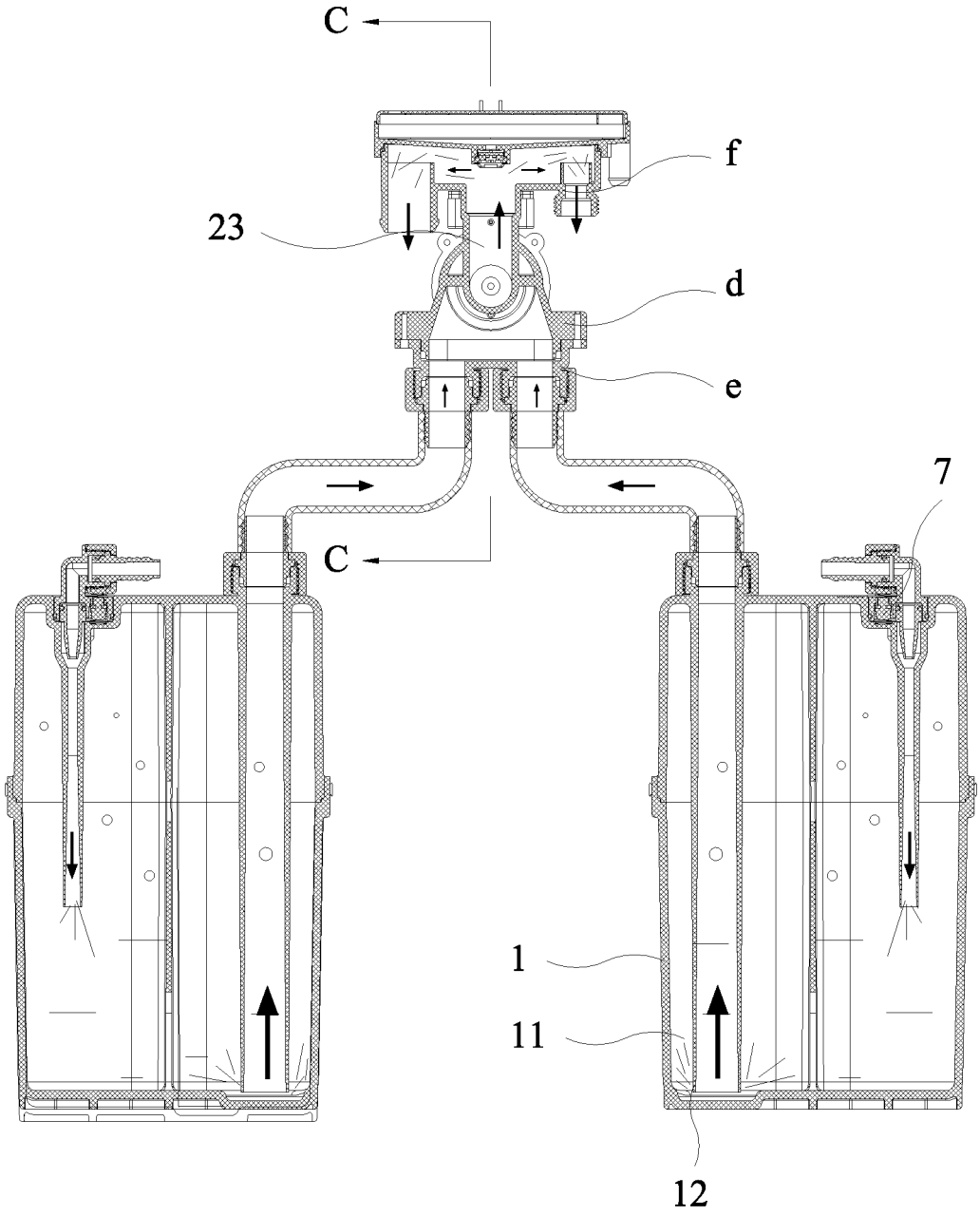
FIG. 8 is a schematic structural drawing of the tank main body according to the second embodiment of the present invention, wherein water is drained.
Figure 9:
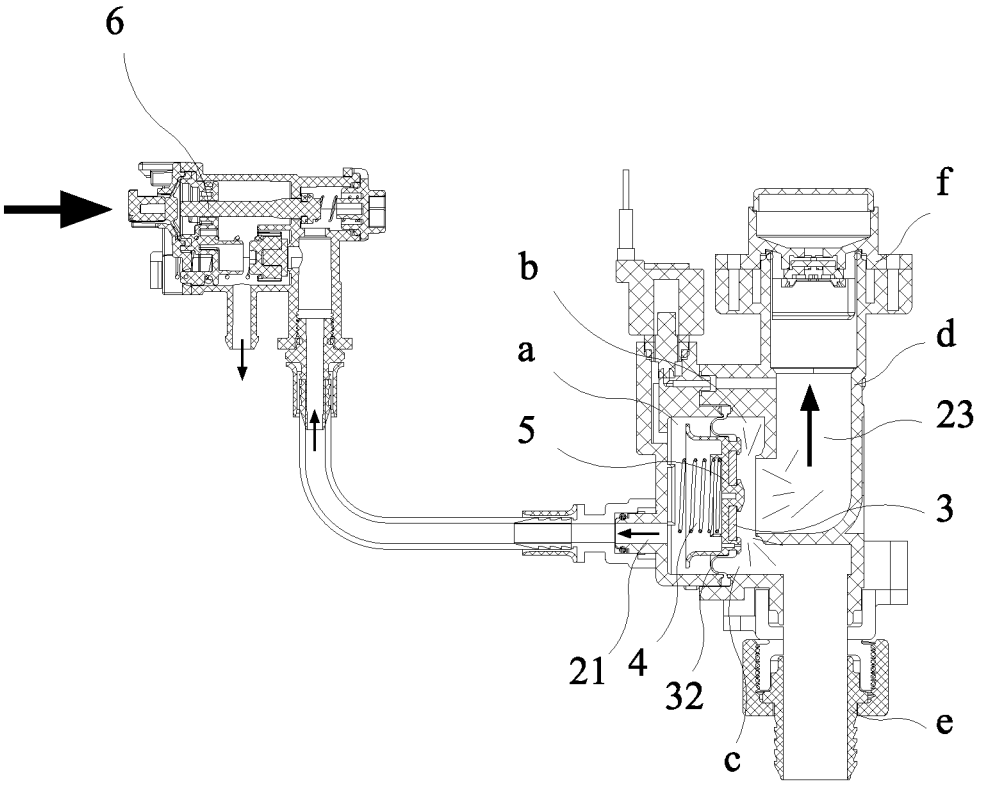
FIG. 9 is a cross-sectional view made along Line C-C in FIG. 8.

Referring to FIG. 8 and FIG. 9, for water drainage, the switch valve 6 is operated, so the water in the back-pressure chamber a flows toward the switch valve 6 through the drain outlet 21 before draining. As a result, the pressure in the back-pressure chamber a decreases, and the water pressure in the drainage chamber b/storage chamber 11 pushes the membrane 3 to open the inlet end of the drainpipe 23, thereby starting water drainage. The water flows from two connecting ends of the outlet end cap f to the waterways of primary flushing water and resining water. While the drainpipe 23 drains water, additional water is supplied to the back-pressure chamber a through the supplement hole c, so that the membrane 3 returns toward the drainpipe 23 slowly. At the expiration of the predetermined water drainage duration, the membrane 3 blocks the drainpipe 23 again to finish water drainage.

The provided embodiments and drawings are not intended to limit the present invention in terms of product form and make. Any proper change or modification made to the embodiments by people with ordinary skill in the art shall be regarded as falling within the scope of the present invention

What is claimed is:

1. A drainage system for a pressure-assisted flush water tank, comprising a tank main body and a drainage structure;

the drainage structure including an accommodating chamber and a membrane; the accommodating chamber having a drain outlet, a water inlet, and a drainpipe; the membrane being movably fit inside the accommodating chamber so as to partition the accommodating chamber into a back-pressure chamber and a drainage chamber, the membrane having a supplement hole that communicates the back-pressure chamber with the drainage chamber; the drain outlet being communicated with the back-pressure chamber, and the water inlet and the drainpipe being communicated with the drainage chamber;

the tank main body defining therein a storage chamber, and the storage chamber being communicated with the water inlet;

whereby water from the storage chamber enters the drainage chamber and then enters the back-pressure chamber through the supplement hole, so as to increase a pressure in the back-pressure chamber, and when the drain outlet is open, the back-pressure chamber drains the water to decrease the pressure so that the membrane moves toward or departs from the drainpipe as the pressure in the back-pressure chamber varies, thereby closing or opening the drainpipe.

2. The drainage system for the pressure-assisted flush water tank of claim 1, wherein the storage chamber has a vertical water passage pipe installed therein, in which the water passage pipe has an upper end communicated with the water inlet and a lower end extending to a bottom of the storage chamber.

3. The drainage system for the pressure-assisted flush water tank of claim 1, wherein the back-pressure chamber has a return spring installed therein, in which the return spring is configured to return the membrane toward the drainpipe, and the accommodating chamber has an inner wall provided with an annular flange for positioning the return spring.

4. The drainage system for the pressure-assisted flush water tank of claim 3, wherein the drainage structure further comprises a movable seat for carrying the membrane, and the return spring is installed between the inner wall of the accommodating chamber and the movable seat, in which the movable seat has a surface provided with a plurality of retaining posts and the membrane is formed with retaining holes matching the retaining post so that the retaining posts are inserted and positioned in the retaining holes.

5. The drainage system for the pressure-assisted flush water tank of claim 4, wherein the supplement hole passes through the membrane and the movable seat.

6. The drainage system for the pressure-assisted flush water tank of claim 1, wherein the membrane has a periphery fixed to a lateral wall of the accommodating chamber, and the membrane is formed with at least a circle of deformable creases.

7. The drainage system for the pressure-assisted flush water tank of claim 1, wherein the drain outlet is located on an upper wall of the accommodating chamber, the water inlet and the drainpipe are both located on a lower wall of the accommodating chamber, and the drainpipe is raised from the lower wall of the accommodating chamber.

8. The drainage system for the pressure-assisted flush water tank of claim 1, further comprising a switch valve communicated with the drain outlet.

9. The drainage system for the pressure-assisted flush water tank of claim 1, further comprising a one-way air valve installed on the tank main body for allowing air supplement when the storage chamber feeds water.

10. The drainage system for the pressure-assisted flush water tank of claim 1, further comprising a pressure relief cover;

the drainage structure being installed in the tank main body; the tank main body being formed with a recess that acts as the drainage chamber, and the storage chamber and the drainpipe being both communicated with the recess; and the pressure relief cover being fit inside the recess and working with the recess to hold a periphery of the membrane; the back-pressure chamber being defined between the pressure relief cover and the membrane, and the pressure relief cover being formed with the drain outlet.

11. The drainage system for the pressure-assisted flush water tank of claim 1, wherein the drainage structure is a separate device located outside the tank main body;

the drainage structure including a valve body that defines the accommodating chamber therein, and having an inlet end cap and an outlet end cap both detachably connected to the valve body, the inlet end cap being provided with at least one of the water inlet, and the outlet end cap being provided with at least one of the drainpipe.

* * * * *